United States Patent [19]

Lorang

[11] 4,037,847

[45] July 26, 1977

[54] GOLF SWING TRAINING APPARATUS

[76] Inventor: Walter R. Lorang, 2239 W. Maple Road, Walled Lake, Mich. 48088

[21] Appl. No.: 655,684

[22] Filed: Feb. 6, 1976

[51] Int. Cl.[2] ..... A63B 69/36

[52] U.S. Cl. ..... 273/187 B; 273/195 B

[58] Field of Search ..... 273/183 R, 183 B, 187 R, 273/187 B, 188 R, 188 A, 195 B; 35/29 A

[56] References Cited

U.S. PATENT DOCUMENTS

| | | | |
|---|---|---|---|
| 3,199,883 | 8/1965 | Freeman | 280/11.14 |
| 3,352,559 | 11/1967 | Larsen | 273/187 R |
| 3,955,821 | 5/1976 | Spedding | 273/187 B |

*Primary Examiner*—George J. Marlo
*Attorney, Agent, or Firm*—William T. Sevald

[57] ABSTRACT

A golf training apparatus having a foot platform which is rockable from side-to-side on a rocket oriented on the long end-to-end axis of the platform. The platform operates on an attached or unattached base and a signal device is attached to the platform to indicate platform rocking movement by the emission of a signal. The platform tilts inwardly toward center in the ball address position. The player stands with his golf shoes on one or two platforms with his body on center and the platforms at ball address position. By not shifting his body away from the target on a proper backswing, the force in his off-target foot remains centered, the off-target platform is not tilted and no signal emits. By subsequently shifting his body toward the target on a proper downswing, the applied force in his target foot moves to the outside of his foot, tilts the platform to the opposite side (IE) outwardly toward the target, and a signal emits. The tilting and non-tilting of the platform together with the signal gives the player the "feel" of a properly executed swing as the platforms provide angular movement in the feet, ankles, calves not obtained in golf shoes which remain untilted under all conditions thus giving no perceptible indication of changes and no signal of improper and/or proper shift of position.

10 Claims, 24 Drawing Figures

Fig-8
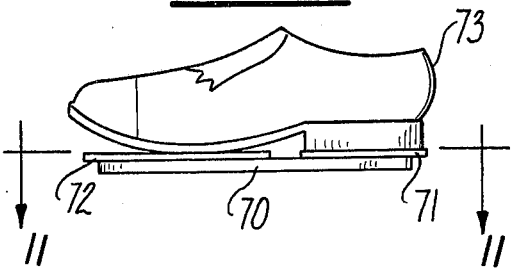
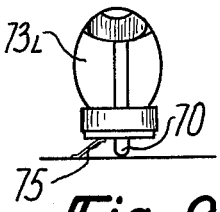
Fig-9
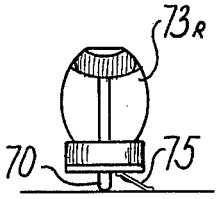
Fig-10
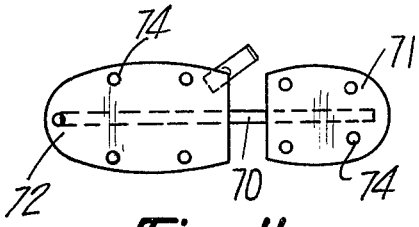
Fig-11
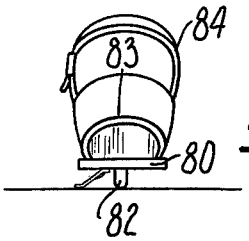
Fig-13
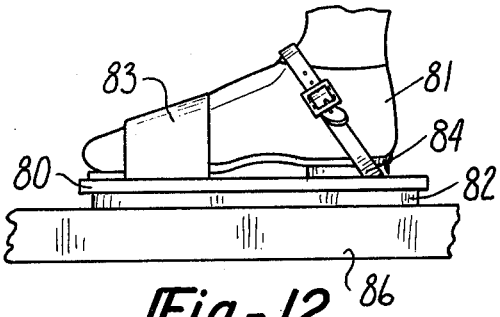
Fig-12
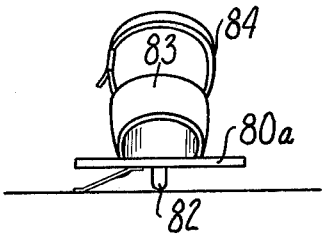
Fig-14
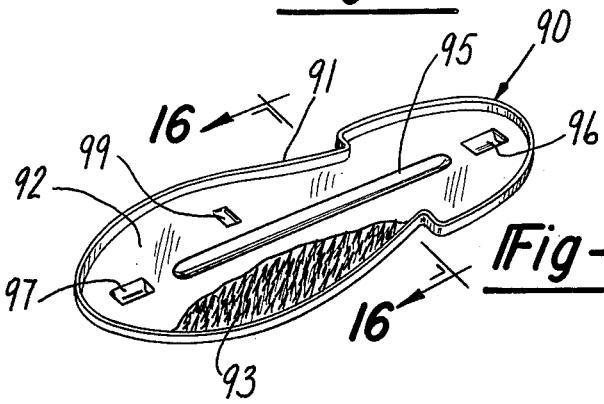
Fig-15
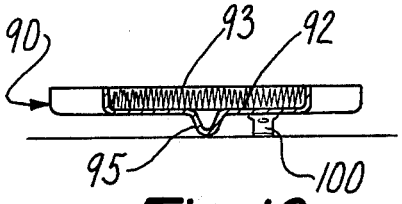
Fig-16
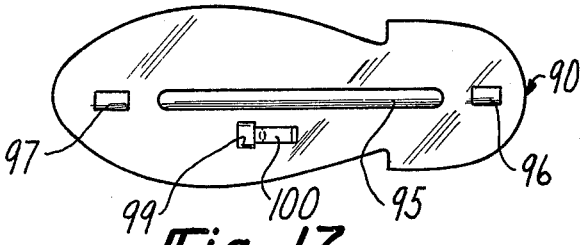
Fig-17
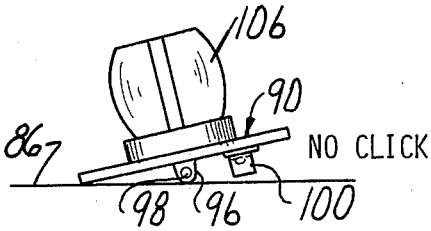
Fig-18

Fig-19
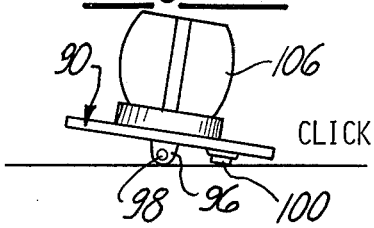
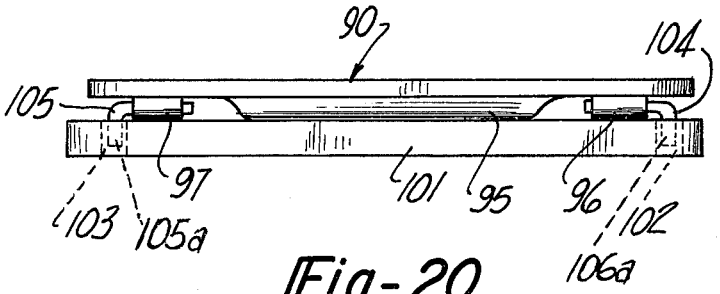
Fig-20
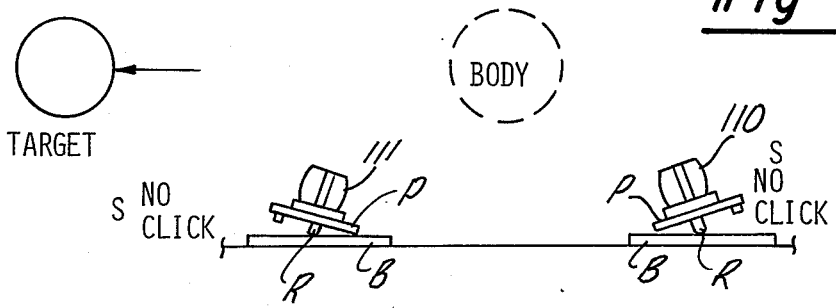
Fig-21
ADDRESS POSITION
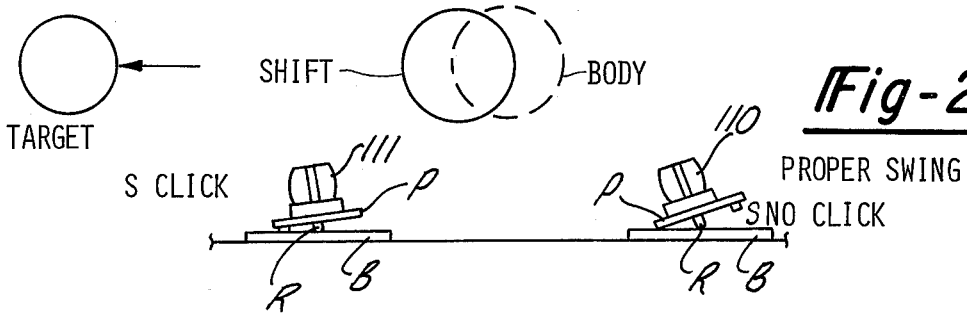
Fig-22
PROPER SWING
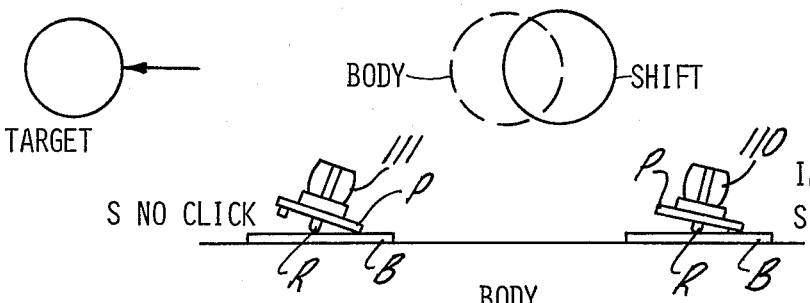
Fig-23
IMPROPER SWING
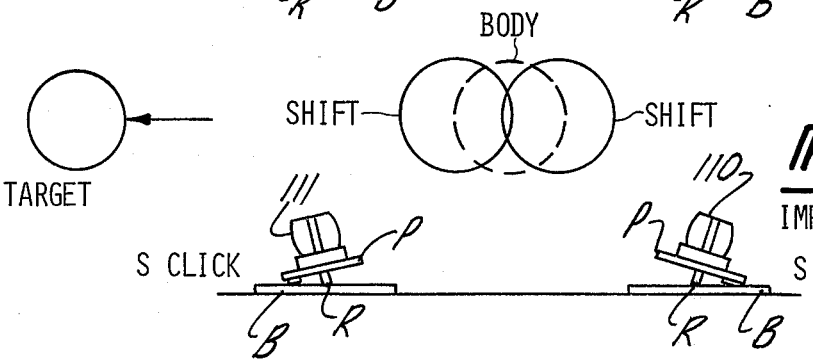
Fig-24
IMPROPER SWING

GOLF SWING TRAINING APPARATUS

BACKGROUND OF THE INVENTION

The flight direction of the ball is the result of the player's swing of the club at impact with the ball. To achieve the straighter flight with the greatest force of impact is the pursuit of all golfers. It is generally accepted that a player should not shift his body away from the target during his backswing; he should remain on balance during his backswing. It is also generally accepted that a player should shift his body toward the target during the start of his downswing. The player doing these two things has the best chance of the ball having a straight flight and long distance for the club used and the force of the swing.

Players do not generally achieve these two things because they can't perceive when they improperly shift their body away from the target on their backswing and they can't perceive that they do not properly shift their body toward the target at their downswing.

Various devices have been developed to help the player achieve a better swing, but most, if not all, have fallen into disuse because they do not give the player an immediate direct feel and signal indication of whether he has properly and/or improperly controlled his body relative to the increments of his swing. The feel is the more important. The feel of making a proper swing is almost impossible to perceive and recognise. It is believed that none of the prior art apparatus give the player not only the feel of making a proper swing but also fail to give him the feel of making an improper swing. Until a player gets this feel he cannot controllably and predictably execute a proper swing.

SUMMARY OF THE PRESENT INVENTION

The apparatus of the present invention gives the player an immediate reaction, indication, read-out and signal that he has made the error of shifting his body away from the target on his backswing, and/or he has made the error of not shifting his body toward the target at the top or during the start of his downswing. It also gives the player the reaction, indication, read-out and signal that he has executed a swing properly. This gives the player the feel he needs to experience to predictably control his swing.

The apparatus of the invention supports either or both feet of the player on a separate individual platform. Each platform is rockable so that it can rock or tilt from side-to-side. The platform has a long end-to-end dimension and a short side-to-side dimension. The axis about which the platform rocks extends from end-to-end. A rocker bar, pivot rod or bearings support the platform along its end-to-end axis. On an attached or unattached platform, with the players foot or feet so positioned, any shift of his body toward or away from the target is reflected by a corresponding tilt of the platform in the same direction as the shift of the body. A signal is provided to advise the player that he has or has not shifted his body as the case may be.

A basic which must be recognised is that when a player has his shoes supported on turf, that the shoes do not tilt with a body shift and any change in the location of static force in his feet is automatically subconsciously compensated for by his bones, nerves and muscles. Thus his body shift is not percipitible to him nor is the change in the position of the static force in his feet resulting from his shift of body weight. He has no feel of what happens when he shifts away from the target on his backswing. His foot is "in the bucket" but he does not know it. He finds out too late after he takes his swing at the ball and the flight of the ball reflects his unbalanced condition. Similarly, when he does not shift his body toward the target at or during the start of his downswing, he is "locked at the top" and again finds this out too late when he hits the ball and it does not go straight and does not go as far as should be expected from the club used and the force exerted in his swing.

Conversely, as compared to executing a swing with his shoes on turf, when a player executes a swing with his shoes on one or two rockable platforms of the invention, he senses a feel and is given a signal. When the player shifts his body away from the target when he winds up in his backswing, the center of static force in his foot also shifts to the outside of his foot and the platform reflects this by tilting and the signal alerts the player as to what happened before he hits the ball. He can now stop, unwind and again wind up his backswing. When the platform tilts there is a feel imparted to the player in his ankles, calves and/or knees because his foot also tilts. The player can know a proper backswing with his off-target shoe on the platform because there is the need for the player to perceptibly hold his ankles, calves and/or knees against flexing as well as to perceptibly hold his body against shifting, and these conscious perceptions give the player the feel of executing the backswing correctly. This feel is thus imparted to him by the rockably mounted platform. This feel cannot otherwise be obtained because the shoes don't rock on turf, and the muscles, nerves and bones subconsciously compensate rendering his improper shift imperceptible.

Similarly, at or during the start of the downswing, with the players target foot on the rockable platform, if he properly shifts his body toward the target, the position of static force in the "target" foot will also shift toward the target. This causes the platform to tilt toward the target and the signal to emit which advises the player that he did shift his body toward the target and when he did; i.e. at what point in his downswing. Since he should shift his weight toward the target preferably at the top or during the start of his downswing, this is an important determination as shifting when the downswing is well under way tends to put the player off balance.

The shift of the body toward the target at or on the downswing with the target foot on the rockable platform results in the tilt of the platform toward the target causing the foot, ankle, calf and/or knee to perceptibly sense the movement and this gives the player the feel of a proper shift and swing. Because the platform tilts the muscles, nerves and bones must perceptively move and this produces the feel of the shift of static force in the target foot toward the target. This cannot be recognised with shoes on turf because of the automatic subconsciouus compensation of the feet in shoes that do not tilt with the changed position of the static force. With only shoes, the lack of the necessary shift is not perceptible nor is the shift itself perceptible to a player who does not have the feel of the expert. Even the experts lose the feel at times.

The platform is preferably used on a flat base to established desired angles of tilt and signal actuation. The preferred signal is auditory as it does not require any focus of attention by the player. When the sound emits, he hears it regardless of concentration. A simple "cricket" clicker is found to be an excellent signal emitter as it makes a peculiar sharp clicking sound without residual resonance. This device is a piece of "dimpled" spring steel which clicks when the dimple is flexed. Electrical signals also are provided.

Structures embodying the invention and their operation will be apparent from the accompanying drawings and from the detailed description of the illustrated embodiments hereinafter set forth.

DESCRIPTION OF THE DRAWINGS

FIG. 8 is a side elevational view of a rocker bar secured to heel and sole plates mounted on a shoe to provide a rocking platform for a player with a signal means attached to the sole plate.

FIGS. 9 and 10 are rear elevational views of the shoe and apparatus seen in FIG. 8 showing the mounting of the signal means for the left and right shoes respectively.

FIG. 11 is a top plan view of the apparatus seen in FIGS. 8–10 with the shoe removed.

FIG. 12 is a side elevational view of a platform on an axial rocker bar for attachment to a shoe by means of a toe loop and a heel strap with the shoe shown in broken lines.

FIG. 13 is a front elevational view of the device seen in FIG. 12 showing the location of the signal means.

FIG. 14 is a view similar to FIG. 13 illustrating a wider platform to reduce angle of tilt.

FIG. 15 is a top perspective view of a platform in the shape of the bottom of a shoe showing the rocker means embossed on the bottom of the platform. FIG. 16 is a transverse cross-sectional view of the platform seen in FIG. 15, taken on the line 16—16 thereof.

FIG. 17 is a plan view of the bottom of the platform seen in FIG. 15 and 16 showing rocker means and signal means more clearly.

FIG. 18 is a rear elevational view of the platform seen in FIGS. 15–17 and additionally showing a shoe positioned thereon and a supporting base in a tilt position with the signal means not activated.

FIG. 19 is a view similar to FIG. 18 but in the opposite position of tilt with the signal means activated.

FIG. 20 is a side elevational view of the platform of FIGS. 15–17 rockably resting on a base with the platform located by means of positioning pins extending between the platform and the base.

FIG. 21 is a diagrammatic view showing a right-handed player's shoes from the rear in position on the platform with the player's body indicated on center in the ball address position without activating any signal means and illustrating the ball addressing position of the platforms with both inclined inwardly toward center.

FIG. 22 is a view similar to FIG. 21 showing that after a properly executed backswing with the body on center and not moved away from the target that the platform under the right shoe has not tilted away from the target and that no signal occurs; and also showing that with the player's proper shift of his body toward the target on his properly executed downswing it results in rocking the platform under the left shoe toward the target by the shift of his body toward the target and that a signal occurred.

FIG. 23 is a view similar to FIGS. 21 and 22 showing an improper body shift away from the target on the backswing rocking the off-target platform to emit a signal indicative of the shift as transferred to the outer side of the right foot and illustrating an improper following downswing by failure to rock the left platform to emit a signal; and FIG. 24 is a view similar to FIG. 23 illustrating an improper shift away from the target on the backswing and then an improper lunge toward the target on the following downswing.

DETAILED DESCRIPTION OF THE ILLUSTRATED EMBODIMENTS

Figure 1:
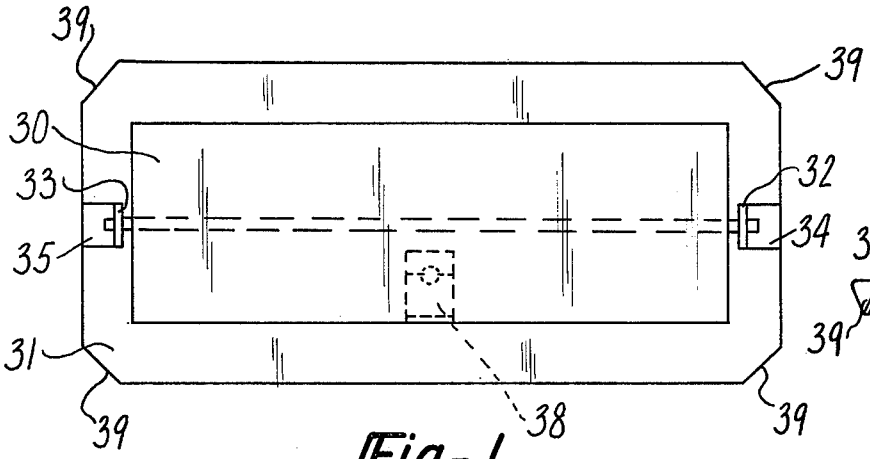
FIG. 1 is a top plan view of an embodiment showing the platform pivotally mounted on a base by means of a rod attached to the platform with the rod being in legs mounted on the base and showing the signal means in broken lines.
Figure 2:
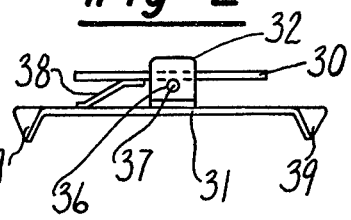
FIG. 2 is an end elevational view of the apparatus shown in FIG. 1.
Figure 3:
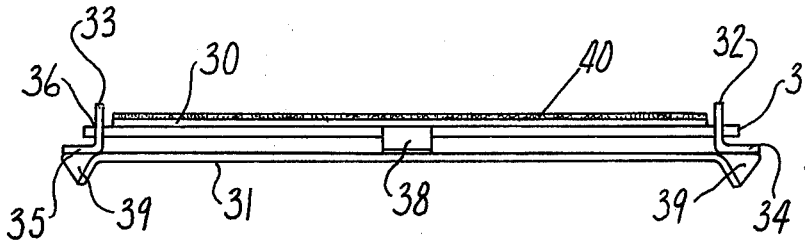
FIG. 3 is a side elevational view of the apparatus shown in FIG. 1.
Figure 4:
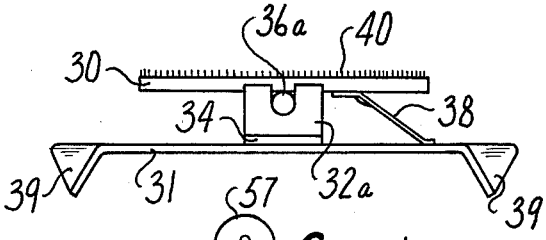
FIG. 4 is an enlarged end-elevational view of the apparatus as seen in FIG. 2 showing a different drop-in pivot mounting, the signal means at the opposite side, the ground engaging corner points, and the carpet-like surface on the platform more clearly.

Referring now to the drawings wherein like reference numerals refer to like and corresponding parts throughout the several views, the novel golf swing training apparatus disclosed therein to illustrate embodiments of the invention comprise a platform 30, FIGS. 1–4. A base 31 lies under the platform 30. Upstanding legs 32 and 33 have tabs 34 and 35 respectively attached to the base 31. The legs 32, 33 have pivot apertures 36. A rod 37 extends between legs 32, 33 and lies in the pivot apertures 36. The platform 30 is secured to and rests on the rod 37. The platform 30 is thus rockably supported. A dimpled spring steel clicker 38 is attached between the platform 30 and the base 31. The corners of the base 31 are bent down at right angles forming ground engaging pointed cleats 39. FIG. 4 shows a modified drop-in slot 36A on the leg 32A for pivotally supporting the rod 37 and a carpet-like member 40 on the platform 30 for engaging the spikes of golf shoes. The rod 37 lies on and illustrates the end-to-end axis of the platform 30.

Figure 6:
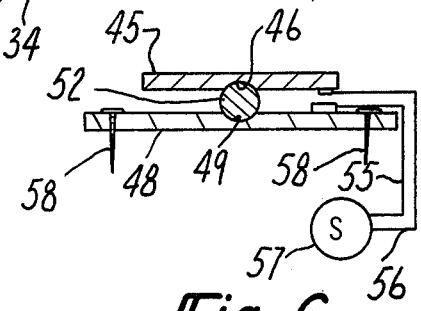
FIG. 6 is a transverse cross-sectional view of the apparatus seen in FIG. 5 taken on the line 6—6 thereof showing the ball receiving pivot sockets in the platform and in the base.
Figure 5:
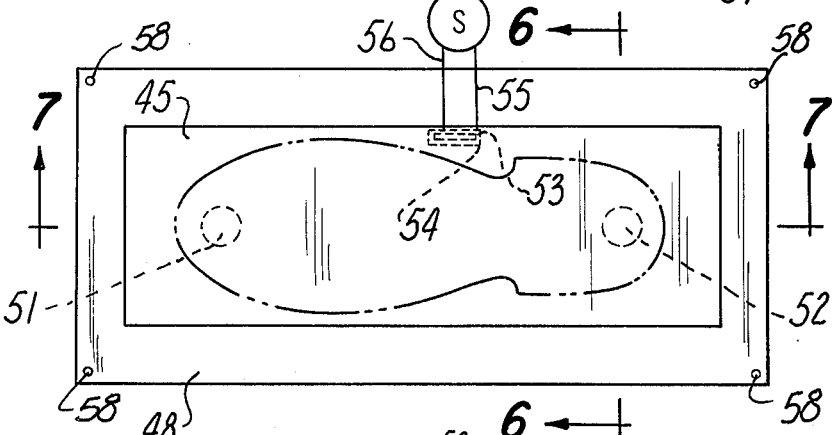
FIG. 5 is a view similar to FIG. 1 illustrating electrical signal means, and ball bearing rocker supports.
Figure 7:
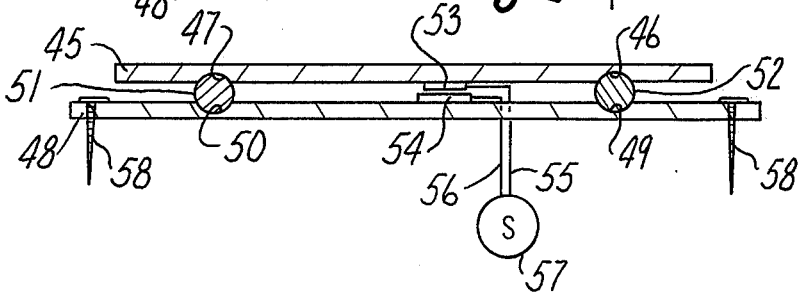
FIG. 7 is a longitudinal cross-sectional view of the apparatus seen in FIG. 5 taken on the line 7—7 thereof.

In FIGS. 5–7, a platform 45 has partial spherical sockets 46 and 47 in its bottom surface lying on its longitudinal end-to-end axis. A base 48 has similar partial spherical sockets 49 and 50 aligned with the sockets 46, 47 and axis of the platform 45. Pivot balls 51 and 52 lie in the sockets 47, 50 and 46, 49 respectively, and rockably support the platform 45 on the base 48. An electrical contact 53 on the platform 45 and an electrical contact 54 on the base 48 are aligned with one another. Wires 55 and 56 lead from the contacts 53 and 54. A signal means 57 is connected to the wires 55 and 56. Upon engagement of contacts 53, 54 occasioned by the platform 45 rocking or tilting, the circuit of the signal means 57 is closed and an audible and/or visual signal is emitted. The base 48 is equipped with ground engaging pegs 58.

Referring now to FIG. 8–11, a rocker bar 70 has an attached heel platform 71 and an attached sole platform 72. The platforms 71 and 72 have screw apertures 74. A shoe 73 is screwed to the platforms 71 and 72. A signal clicker 75 is carried by the sole or heel platforms 71, 72. The clicker 75 is mounted on the outer side of the shoe 73L and 73R, FIGS. 9 and 10.

Referring now to FIGS. 12–14, a platform 80 is provided to support shoe 81. A rocker bar 82 is fixed to the bottom of the platform 80. A loop 83 on the platform 80 overlies the toe of the shoe 81 and a heel strap 84 on the platform 80 engages the back of the shoe 81. Platform 80A, FIG. 14, is a wider modification to reduce the angle of rock or tilt. Signal means 85 are attached to the platforms 80 and 80A.

A base 86 provides support for the platforms 71, 72, 80 and 80A and rocker bars 70 and 82 of FIGS. 8–14. The base 86 may be a piece of plywood, a board, a metal plate, a slab of concrete, hard soil, turf, etc.

Referring now to FIGS. 15–20, a platform 90 is shaped like a foot-print or the bottom of a shoe. An upstanding flange 91 extends around the periphery of the top of the platform 90 forming a receiving socket. Carpet 93 lies in the socket on the top of the platform 90 within the upstanding flange 91. The platform 90 has a bottom 92. A rocker bar 95 is pressed out of the bottom 92. The rocker bar 95 may extend from heel to toe or it may have a central portion 95C and end portions 96 and 97. Axial apertures 98 are formed in the end portions 96 and 97. The rocker bar 95 rests on a base 86, FIGS. 18 and 19. A strap portion 99 is lanced out of the bottom 92 forming receiving slots. A dimpled spring steel "clicker" 100 lies in the slots under the strap 99. The strap 99 is compressed on the clicker 100 holding the clicker 100 in place.

The embodiment of FIG. 20 has a base 101. The rocker bars 95, 96 and 97 rest on the base 101. The base 101 has sockets 102 and 103. A pin 104 is inserted into the end portion 96 of the rocker bar 95 through its aperture 98, and a pin 105 is inserted into the end portion 97 of the rocker bar 95 through its aperture 98. The pins 104 and 105 are L-shaped. The short legs 104A and 105A of the pins 104 and 105 lie in the sockets 102 and 103 respectively of the base 101. The pins 104 and 105 thus position the platform relative to the base 101. Electrical signal means may be used with the embodiment of FIG. 20, as well as mechanical means.

The device of FIGS. 15–20 thus may be used with or without a particular base as seen in FIG. 20 and as shown in FIGS. 18 and 19 where the platform 90 rockably rests on the base 86.

The shoe 106 and the position of the platform 90 of FIG. 18 together with the unactuated signal illustrates the proper position on the backswing and for the following downswing of the right or off-target foot of a right-handed player. Here the player does not move bodily away from the target on his backswing and his off-target foot is set for his downswing.

The shoe and position of the platform 90 of FIG. 19 together with the actuated signal illustrates the improper position on the backswing and the following downswing of the right or off-target foot of a right handed player. Here the player has moved bodily away from the target on his backswing and his off-target foot is not set for his downswing. Moreover, his body is off balance away from the target.

These positions and conditions are more fully explained, as well as the positions and conditions of the player's target foot and platform in the following description of FIGS. 21–24 which provide schematic illustration.

Referring now to the use and operation of the various modifications of the invention, FIGS. 21–24, golf shoes 110 and 111 represent the right and left feet respectively of a right-handed player who aims at a target to his left. A dotted common center-line is provided through the figures to correlate the movements of the body, feet, platforms and signals relative to one another to indicate the difference between a proper and an improper golf swing.

The player's shoes 110 and 111 in the address position FIG. 21 are centered on the platforms P over the rocker or pivot element R so that with his knees bent and held toward one another the shoes and platforms are rocked inwardly over the base B with the signals on the outer sides of the platforms unactivated and the body on center. Here the muscles have adjusted to a position of the body on center and the impingement of the static force in each shoe over the rocker element R toward body center due to the held-in bent knees.

Referring now to FIG. 22, the player executed a proper swing as he has maintained his body on center during his backswing, has shifted his body toward the target at his downswing. Thus the position of static force was not changed in the player's right foot and shoe 110 and the platform did not rock to the outside: i.e. he did not improperly shift his body away from the target on his backswing. However, he did properly shift his body toward the target in his downswing and this changed the position of impingement of static force in the player's left foot and shoe 111 to the outside causing the platform to rock to the outside and the signal to emit.

FIG. 23 illustrates that the player has improperly shifted his body away from the target on his backswing changing the position of impingement of static force in his right foot and shoe 110 to the outside of the shoe 110 in the same direction as the shift of the body. He now has his foot in the bucket and fails to shift his body toward the target on his downswing so that his left foot and shoe 111 do not rock the platform outwardly toward the target and no signal emits.

FIG. 24 illustrates that the player has improperly shifted his body away from the target on his backswing causing the signal to emit at his right shoe whereupon the player attempts to correct this first mistake by overshifting his body toward the target from his off center position away from the target. This shifts his body over center toward the target and the force on his left shoe 111 moves to the outside rocking the platform and emitting a signal. Regardless of the final shift toward the target, this is not a proper swing as the player has to lunge into his second position toward the target causing great loss of power at the club head, timing, body control and ball direction.

While various embodiments of the invention have been shown and described to illustrate the invention, it will be understood that the invention is not limited to them and is limited only by the scope of the appended claims.

I claim:

1. Golf swing training apparatus for teaching a player how to control the position of his body during the swing of the club at the ball comprising;

a platform for supporting a player's foot; said platform having a heel end, a toe end, opposite sides, and a central axis extending between said heel and toe ends;

rocker means on said platform for bi-directionally rockably supporting said platform on a base; said rocker means being aligned on said central axis of said platform to permit said platform to rock from side-to-side; said platform being bi-directionally rockable between a position toward the target and a position inclined away from the target; and signal means connected to said platform to advise the player upon said platform rocking;

a player with his off-target foot on said platform with said platform inclined toward the target being advised of proper body positioning during his backswing by said platform not rocking and remaining inclined toward the target and being advised of improper body positioning during his backswing by said platform rocking in the off-target direction to an inclination away from the target and activating said signal means thereby indicating and signaling a body shift away from the target;

a player with his target foot on said platform being advised of proper body positioning during his downswing by said platform rocking in the target direction from an inclination away from the target to an inclination toward the target and activating said signal means thereby indicating and signaling a shift of his body toward the target, and being advised of improper body positioning during his downswing by said platform not rocking toward the target and remaining inclined away from the target and not activating said signal means thereby indicating and signaling that he did not shift his body toward the target.

2. In an apparatus as set forth in claim 1, a second said platform, and second said signal means:

a player with one foot on each said platforms being advised of proper body positioning by one said rockably mounted platform and signal means on his backswing and by said other rockably mounted platform and signal means on his downswing.

3. In apparatus as set forth in claim 1, a base lying below said platform; said rocker means rockably supporting said platform on said base.

4. In apparatus as set forth in claim 1, a base lying below said platform, and pivot means rockably mounting said platform on said base.

5. In apparatus as set forth in claim 1, a base lying below said platform having at least one pin receiving socket, and at least one positioning pin on said platform depending downwardly therefrom; said depending pin on said platform lying in said socket of said base to locate said platform and said base relative to one another.

6. Golf swing training apparatus for teaching a player how to control the position of his body during the swing of the club at the ball comprising:

a platform for supporting a player's foot; said platform having a heel, a toe end, opposite sides, and a central axis extending between said heel and toe ends; and rocker means on said platform bi-directionally rockably supporting said platform on a base; said rocker means being aligned on said central axis of said platform and positioned to engage a base at a point substantially directly below said axis and to permit said platform to rock from side-to-side and engage a base laterally of said point;

said platform being bi-directionally rockable between a position inclined toward the target and a position inclined away from the target;

a player with his off-target foot on said platform with said platform inclined toward the target being advised of proper body positioning during his backswing by said platform not rocking and remaining inclined toward the target, and being advised of improper body positioning during his backswing by said platform rocking from an inclination toward the target to an inclination away from the target to indicate a body shift away from the target;

a player with his target foot on said platform with said platform inclined away from the target being advised of proper body positioning during his downswing by said platform rocking from an inclination away from the target to an inclination toward the target thereby indicating a shift of his body toward the target, and being advised of improper body positioning during his downswing by said platform not rocking from an inclination away from the target to an inclination toward the target thereby indicating that he did not shift his body toward the target.

7. In an apparatus as set forth in claim 6, a second said platform;

a player with one foot on each said platform being advised of proper body positioning by one said rockably mounted platform on his backswing and by said other rockably mounted platform on his downswing.

8. In an apparatus as set forth in claim 6, a base lying below said platform; said rocker means rockably supporting said platform on said base.

9. In an apparatus as set forth in claim 6, a base lying below said platform, and pivot means rockably mounting said platform on said base.

10. In an apparatus as set forth in claim 6, a base lying below said platform having at least one pin receiving socket, and at least one positioning pin on said platform depending downwardly therefrom; said depending pin on said platform lying in said socket of said base to locate said platform and said base relative to one another.

* * * * *